US007662262B2

(12) United States Patent
Hamel

(10) Patent No.: US 7,662,262 B2
(45) Date of Patent: Feb. 16, 2010

(54) SUPERCALENDERING OPTIMIZATION USING A STEAM SHOWER

(75) Inventor: Robert G. Hamel, Bowen Island (CA)

(73) Assignee: ABB Ltd., Dublin (IE)

( * ) Notice: Subject to any disclaimer, the term of this patent is extended or adjusted under 35 U.S.C. 154(b) by 186 days.

(21) Appl. No.: 11/863,897

(22) Filed: Sep. 28, 2007

(65) Prior Publication Data

US 2008/0017344 A1 Jan. 24, 2008

Related U.S. Application Data

(62) Division of application No. 10/208,643, filed on Jul. 30, 2002, now Pat. No. 7,294,235.

(51) Int. Cl.
*D21H 11/00* (2006.01)

(52) U.S. Cl. ..... 162/361; 162/375; 162/206; 162/224; 162/290; 100/38; 100/41; 34/114; 34/124

(58) Field of Classification Search ..... 162/361, 162/375, 360.2, 206, 205, 207, 224, 290; 100/38, 41; 34/114, 124
See application file for complete search history.

(56) References Cited

U.S. PATENT DOCUMENTS

| | | | |
|---|---|---|---|
| 6,073,549 | A | 6/2000 | Winheim |
| 6,694,870 | B1 | 2/2004 | Pietikainen |
| 2001/0008181 | A1 | 7/2001 | Anderson |

FOREIGN PATENT DOCUMENTS

| | | |
|---|---|---|
| PL | 121374 | 9/1983 |

OTHER PUBLICATIONS

Klepaczka and Tarnawski "One-Sided Gloss-Calendering of Paper" (NDN 188-0117-2655-0) Przeglad Papier. 37,No. 7/8: 259-261) (Jul./Aug. 1981).

*Primary Examiner*—Mark Halpern
(74) *Attorney, Agent, or Firm*—Michael C. Prewitt

(57) ABSTRACT

There is described a method and apparatus for applying steam from a steam source to a moving web to thereby improve the smoothness and gloss of the web. A housing has at least one cooling chamber upstream and at least one steam chamber downstream. The cooling air in the cooling chamber is used to cool the web before steam is applied to the web from the steam chamber. This allows a sufficient volume of steam to be delivered to the web to thereby raise its moisture content to a desired level to thus achieve optimized calendering of the web.

9 Claims, 2 Drawing Sheets

SUPERCALENDERING OPTIMIZATION USING A STEAM SHOWER

CROSS REFERENCE TO RELATED APPLICATION

This application is a divisional under 35 U.S.C. §120 of U.S. patent application Ser. No. 10/208,643 filed on Jul. 30, 2002, entitled "Supercalendering Optimization Using A Steam Shower" the entirety of which is incorporated herein by reference.

FIELD OF THE INVENTION

This invention relates to an apparatus and method to effectively deliver hot steam to a web of paper, and more specifically to an apparatus and method intended for efficient use of steam shower with a supercalender to improve the smoothness and gloss of the paper.

DESCRIPTION OF THE PRIOR ART

Supercalenders are employed in the papermaking industry to improve the smoothness or gloss of the surface finish of a paper web. The supercalendering process is intended for certain high quality printing papers in which it is necessary to improve the surface properties beyond that produced on the basic papermaking machine.

The supercalender consists of a stack of rolls forming multiple press nips through which the paper sheet is passed. Alternate rolls have "soft" surfaces and are stacked between hard metal rolls. Because the hard rolls normally have smaller diameters than that of the soft rolls, the press nip formed between the rolls deforms the soft roll creating an extended nip surface on the soft roll. The surfaces of the soft rolls deform as the rolls turn and the paper sheet enters into the nip and again passes out of the nip. The important deformation is relative to the surface of the hard roll that has a relatively larger curvature. Thus as a paper sheet is passed through the nip, it experiences a small relative "sliding" or "expanding" of the soft roll surface on the paper sheet surface. This modifies the surface with little or no effect on the bulk of the paper sheet and improves properties such as gloss and smoothness.

The effect is one sided in that only the surface contacted by the soft roll is modified. To create a two sided effect, the supercalender stack will put two similar rolls together in the middle such that the upper stack will present soft rolls to one side of the paper sheet and the lower stack will present soft rolls to the other side of the paper.

It has been found that changes in moisture and temperature have an additional supercalendering effect on the paper sheet as it passes through the stack. Since the desired effect is on the surface of the paper, it is the surface temperature and surface moisture of the paper that is important.

In the production of paper, steam can be used to modify the moisture content and temperature of the paper web. Equipment used to add the steam to the paper web is generally referred to as a steam shower. Steam showers can be used successfully on the supercalendering process as long as careful attention is paid to the volume of steam delivered. The steam that condenses on the paper web serves to increase both the temperature and moisture content of the web. In fact, condensing steam on the paper is one of the best methods of adding moisture evenly and without "mottling" the surface.

Nevertheless, steam showers used in this application can only offer limited benefits because of the limited capability of the sheet to condense the steam on its surface. It has been found the sheet cannot condense more steam on its surface after the temperature on the sheet surface exceeds a certain threshold value.

Klepaczka and Tarnawski disclose in Polish patent No. 121374 and the related Journal article "One-Sided Gloss-Calendering of Paper" (NDN 188-0117-2655-0) published in Przeglad Papier. 37, no. 7/8: 259-261 (July/August 1981) a configuration that uses two cylinders in contact with the paper web upstream of a steam shower to cool the web. The authors claim that the temperature of the web with 95% dryness must be in the range of 35 to 50° C. before the steam shower in order to achieve effective performance from the steam treatment. The patent and the article do not further describe either the cylinders or the method of cooling.

Standard papermaking machines do not include cooling cylinders. Therefore while cooling the web by using such cylinders is effective, it involves a structural modification of the papermaking machine and is complicated in construction and consequently expensive.

Thus it would be desirable to cool the paper web by a method and apparatus that does not involve a structural modification of the papermaking machine. The present invention accomplishes that result without a structural modification of the papermaking machine and therefore is more cost effective than the prior art.

The present invention cools the paper web by applying cooling air across the web surface before the steam treatment. The cooling air may be applied by using either a vacuum or a blower.

One of the benefits of the present invention is to allow the paper maker to use conventional steam shower technology on hot inline supercalenders where the web is too hot to use the steam showers without pre-cooling.

Another benefit of the present invention is the optimized efficiency of the steam showers. The cooler paper web condenses more steam on its surface to allow maximized supercalendering effect. Moisture saturation resulting from surface temperature over the threshold value at the sheet surface causes excessive steam to escape to the atmosphere and makes the steam shower less efficient. Cooling down the sheet before applying steam extends the temperature range for steam treatment and delays the moisture saturation due to reaching the temperature limitation on the paper surface. Maximized efficiency of the steam shower results in either higher gloss or smoothness of the paper products, or the capability to achieve targeted gloss or smoothness with less nips or rolls.

Yet another benefit of the present invention is to separate sheet moisture control from sheet temperature control. By controlling the moisture level on the paper surface, one can make sure that the optimization of the supercalendering effect is achieved.

SUMMARY OF THE INVENTION

A method for controlling the moisture of a moving web in a supercalendering process. The method uses cooled air to cool the moving web to a predetermined temperature; and increases the moisture content of the cooled moving web by applying steam to the web.

A machine for making a paper web that has a supercalender. The supercalender has one or more pairs of stacked rolls, each of the pairs of stacked rolls forming a press nip through which the paper web can pass; and one or more steam application devices positioned downstream of the one or more pairs of stacked rolls and extending across the paper web. Each of the steam application devices has a chamber positioned for cooling the paper web using cooling air; and a chamber positioned downstream of the cooling chamber for applying steam to the paper web.

A device for applying steam across a paper web. The steam applying device has a chamber positioned for cooling the paper web using cooled air; and a chamber positioned downstream of the cooling chamber for applying steam to the paper web.

DESCRIPTION OF THE PREFERRED EMBODIMENT(S)

Figure 1:
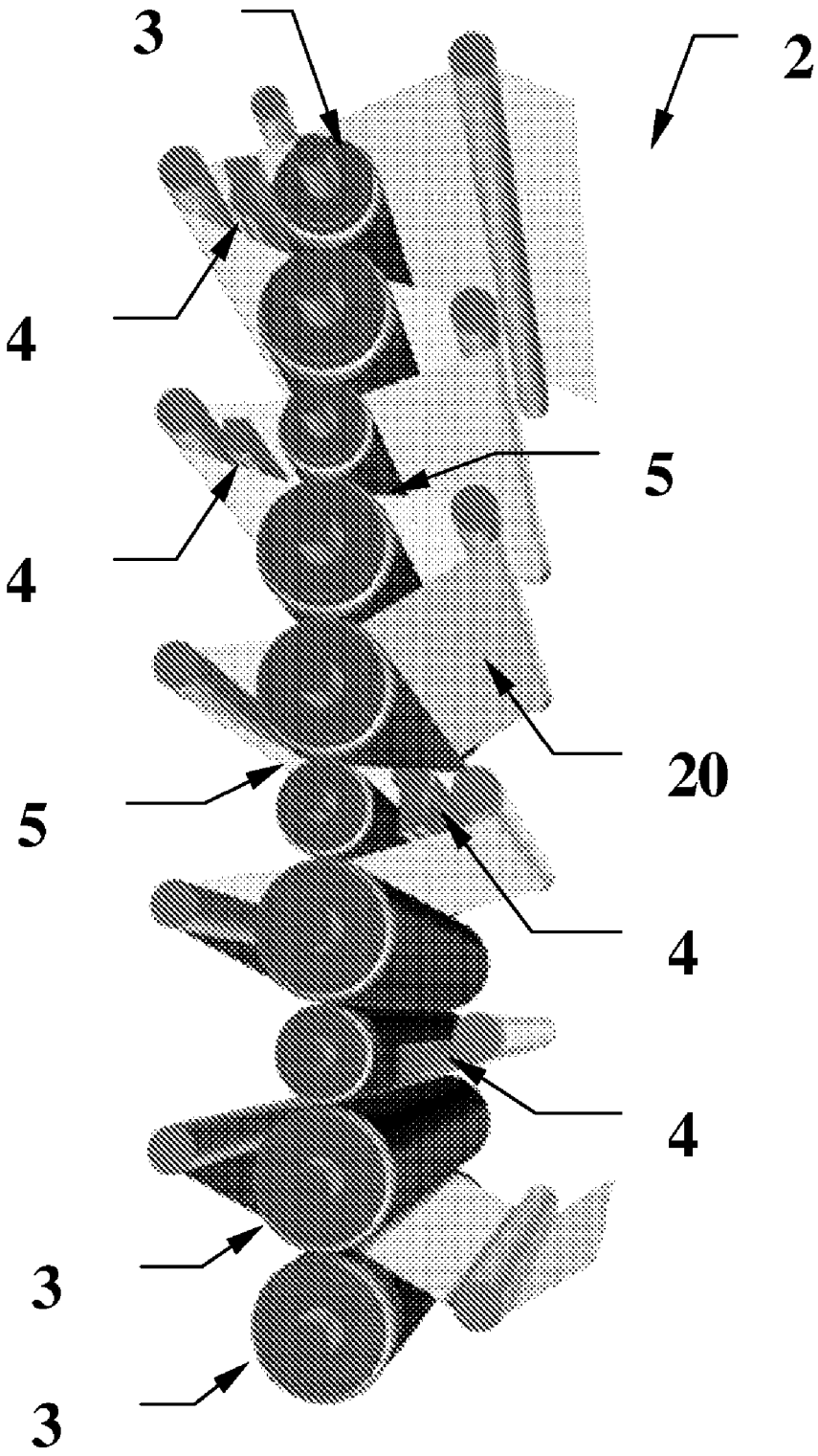
FIG. 1 shows a schematic view of a supercalender incorporating one embodiment for the steam application device of the present invention.

FIG. 1 shows a supercalender arrangement 2 that incorporates the stationary steam application device 4 of the present invention. The supercalender arrangement 2 comprises a series of stacked rolls 3 that forms multiple press nips 5. As is also conventional, the steam application device 4 extends in the cross-machine direction across the width of the paper web 20 to deliver steam to the paper web 20 as it moves past the device immediately before entering the nip 5 between two rollers to undergo supercalendering.

Figure 2:
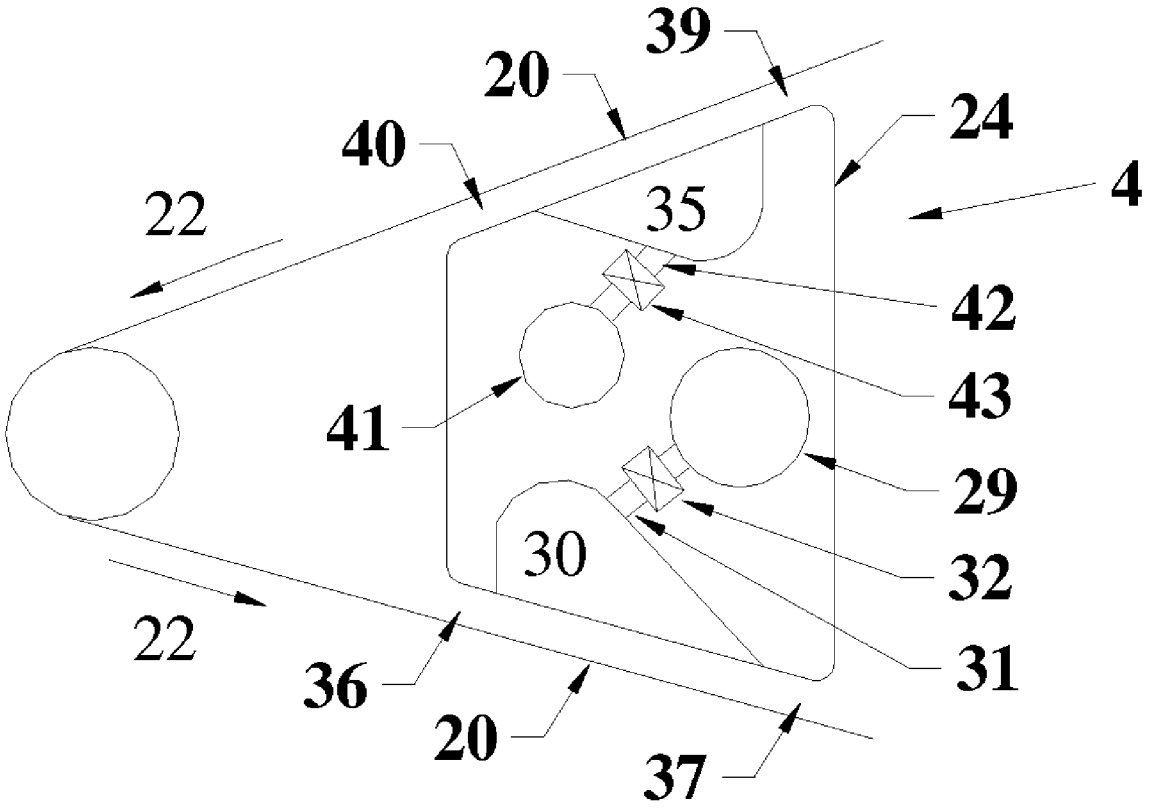
FIG. 2 shows a detailed schematic view of the embodiment for the steam application device incorporated in the supercalender of FIG. 1.

FIG. 2 is a detailed section view of steam application device 4 showing schematically the cross-sectional structure of a preferred embodiment of that device. The paper web 20 moves in the direction indicated by arrow 22 past the stationary device 4. The device 4 includes a housing 24 having a cooling chamber 35 and a steam chamber 30 positioned adjacent the moving paper web 20. The cooling chamber 35 is located upstream of the steam chamber 30, indicating that the web sheet 20 is cooled down by cooling air from chamber 35 before heated by the steam from chamber 30.

The cooling chamber 35 includes means for moving cooling air over paper web 20 to lower the temperature of the web. The means for moving cooling air preferably comprises a vacuum source for drawing cooling air in the environment into the cooling chamber 35 or a fan unit for blowing cooling air into the cooling chamber 35. Referring to FIG. 2, there is shown a main passage 41 for moving air that communicates with the vacuum source (not shown) or the fan unit (not shown). The main passage 41 includes an opening 42 that communicates with cooling chamber 35.

If a vacuum source is used, the source is sized to generate sufficient negative pressure in main passage 41 to draw outside cooling air through two gaps 39 and 40 across the web surface and into cooling chamber 35 to cool down the web 20. The two gaps 39 and 40 are defined by the spaces between the web sheet surface and the surface of the housing 24 around the cooling chamber 35. If a fan unit is used, the unit is sized to blow air through main passage 41, into the cooling chamber 35 and out through the two gaps 39 and 40.

Cooling chamber 35 can be a single chamber extending across the housing in the cross-machine direction to generate a substantially uniform sheets of cooling air that move over the paper web 20 through the gaps 39 and 40. Alternatively, chamber 35 can be a plurality of cooling chambers extending across the housing in the cross-machine direction to define discrete control zones. An air flow valve 43 is associated with each cooling chamber to control the flow of air created by positive or negative pressure in main passage 41. A conventional feedback control scheme (not shown) permits adjustment of the cooling air flow at each cooling chamber 35 via the air flow valve 43 to create a consistent or desirable temperature profile across the paper web 20.

Extending through housing 24 there is another main supply header 29 in communication with a steam source (not shown). The main supply header 29 distributes steam from the steam source to the at least one steam chamber 30 via outlet 31 to apply heat and moisture to the web between two gaps 36 and 37. The two gaps 36 and 37 are defined by spaces between the web sheet surface and the surface of the housing 24 near the steam chamber 30.

Preferably, a steam flow valve 32 controls the flow of steam from the main supply header 29 to steam chamber 30. As in conventional steam application devices, there is normally a plurality of steam chambers 30 extending across the housing in the cross-machine direction. Each steam chamber has its own associated steam flow valve 32 for independently delivering a controlled flow of steam to the region or zone of the paper web 20 beneath the chamber 30.

In a conventional feedback control scheme, downstream scanners can measure properties across the width of the paper web 20 and provide feedback to a controller (not shown). The controller is able to independently adjust the steam flow valves 32 to modify the properties of the sheet 20 in various zones to establish a consistent properties profile across the entire paper web 20.

As is described above, the method and apparatus of the present invention cools down the paper web 20 before applying conventional steam treatment using steam showers. The present invention allows traditional steam showers to deliver sufficient steam into contact with the paper web 20 in the confined area of the steam chamber 30 to raise the moisture content of the web, without raising the temperature of the web beyond accepted working levels for supercalendering. As a result of raising the moisture content as desired, supercalendering optimization can be achieved.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A device for use in a supercalendering apparatus that processes a paper web, the device including:

a housing positioned proximate to the paper web, a cooling chamber positioned in said housing and facing the paper web, said cooling chamber drawing air across the paper web by drawing a vacuum in said cooling chamber, a steam chamber positioned in said housing and facing the paper web at a location downstream of said cooling chamber, said steam chamber applying steam to the paper web wherein said housing includes a first side and a second side, said first side being on the opposed side of said housing from said second side, said cooling chamber being positioned at said first side and said steam chamber being positioned at said second side.

2. A device for use in a supercalendering apparatus that processes a paper web having a first side and an opposed second side, the device including:

a housing positioned proximate to the paper web, said housing includes a first side and a second side, said first side being on the opposed side of said housing from said second side, a cooling chamber positioned in said housing and facing the first surface of the paper web, said cooling chamber drawing air across the paper web and being positioned at said first side of said housing, and a steam chamber positioned in said housing and facing the first side of the paper web, said steam chamber applies steam to the paper web and is positioned at said second side of said housing.

3. The device according to claim 2 wherein said cooling chamber is maintained at a lower pressure than atmospheric pressure.

4. A supercalendering system for processing a paper web comprising:

a first roller positioned adjacent a second roller to form a first nip;

a third roller positioned adjacent said second roller to firm a second nip;

a fourth roller positioned in a spaced relation from said first, second and third rollers, each of said rollers being adapted to rotate to draw the paper web through said first nip, around said fourth roller and through said second nip;

a device having a first side and an opposed second side, a cooling chamber being positioned at said first side and adjacent the paper web, and a steam chamber being positioned at said second side and adjacent the paper web; and wherein said cooling chamber draws air over the paper web and said steam chamber directs steam toward the paper web.

5. The supercalendering system of claim 4 wherein said device is positioned between said second roller and said fourth roller.

6. The supercalendering system of claim 4 wherein said cooling chamber draws air across an upstream portion of the paper web relative to said steam chamber.

7. The supercalendering system of claim 4 wherein said cooling chamber is maintained at a lower pressure than atmospheric pressure.

8. The supercalendering system of claim 4 wherein a first portion of the paper web extends between said first nip and said fourth roller and a second portion of the paper web extends between said fourth roller and said second nip, said device being positioned between said first portion of the paper web and said second portion of the paper web.

9. The supercalendering system of claim 8 wherein said cooling chamber is positioned adjacent said first portion and said steam chamber is positioned adjacent said second portion.

* * * * *